US009951407B2

(12) United States Patent
Yonekura et al.

(10) Patent No.: US 9,951,407 B2
(45) Date of Patent: Apr. 24, 2018

(54) WIPING NOZZLE OF HOT-DIP METAL PLATING EQUIPMENT AND WIPING POSITION CONTROL DEVICE FOR HOT-DIP METAL PLATING EQUIPMENT

(71) Applicant: PRIMETALS TECHNOLOGIES JAPAN, LTD., Tokyo (JP)

(72) Inventors: Takashi Yonekura, Hiroshima (JP); Masao Tanbara, Hiroshima (JP); Masashi Yoshikawa, Hiroshima (JP)

(73) Assignee: PRIMETALS TECHNOLOGIES JAPAN, LTD., Tokyo (JP)

( * ) Notice: Subject to any disclaimer, the term of this patent is extended or adjusted under 35 U.S.C. 154(b) by 18 days.

(21) Appl. No.: 15/311,031

(22) PCT Filed: Apr. 23, 2015

(86) PCT No.: PCT/JP2015/062328
§ 371 (c)(1),
(2) Date: Nov. 14, 2016

(87) PCT Pub. No.: WO2015/174234
PCT Pub. Date: Nov. 19, 2015

(65) Prior Publication Data

US 2017/0114437 A1 Apr. 27, 2017

(30) Foreign Application Priority Data

May 15, 2014 (JP) ..... 2014-101118

(51) Int. Cl.
*C23C 2/20* (2006.01)
*B05C 11/02* (2006.01)
(Continued)

(52) U.S. Cl.
CPC ..... *C23C 2/20* (2013.01); *B05C 11/02* (2013.01); *B05C 11/06* (2013.01); *C23C 2/18* (2013.01); *B05C 9/08* (2013.01); *C23C 2/003* (2013.01)

(58) Field of Classification Search
None
See application file for complete search history.

(56) References Cited

U.S. PATENT DOCUMENTS 3,607,366 A * 9/1971 Kurokawa ..... B05C 11/06 118/63
3,841,557 A * 10/1974 Atkinson ..... C23C 2/20 118/63
(Continued)

FOREIGN PATENT DOCUMENTS

EP 2 140 944 A1 1/2010
EP 2 708 616 A1 3/2014
(Continued)

*Primary Examiner* — Jethro M Pence
(74) *Attorney, Agent, or Firm* — Birch, Stewart, Kolasch & Birch, LLP

(57) ABSTRACT

The present invention reduces the amount of gas consumed, edge-overcoating and splashing and adjusts plating thickness with high precision by providing a wiping nozzle with: thin plates, which are each inserted into a lip from the entrances to the lip for a specified distance to the inside of the two ends of the lip in the sheet width direction in order to seal the gas jet where the thin plates are inserted, and which are movable in the sheet width direction of the lip; and ropes extending in the sheet width direction of the lip so as to track the movements of the thin plates and seal the gas jet in a specified range.

4 Claims, 6 Drawing Sheets

(51) Int. Cl.

| | |
|---|---|
| ***B05C 11/06*** | (2006.01) |
| ***C23C 2/18*** | (2006.01) |
| *B05C 9/08* | (2006.01) |
| *C23C 2/00* | (2006.01) |

(56) References Cited

U.S. PATENT DOCUMENTS

| | | | | | |
|---|---|---|---|---|---|
| 3,917,888 | A * | 11/1975 | Beam | C23C 2/20 | 427/433 |
| 4,041,895 | A * | 8/1977 | Overton | B05C 11/06 | 118/419 |
| 4,346,129 | A * | 8/1982 | Decker | C23C 2/20 | 118/419 |
| 5,221,345 | A * | 6/1993 | Blankenship | B05C 11/06 | 118/419 |
| 2004/0050323 | A1* | 3/2004 | Chae | C23C 2/14 | 118/400 |
| 2008/0026134 | A1* | 1/2008 | Kayama | C23C 2/14 | 427/9 |
| 2010/0031879 | A1* | 2/2010 | Kim | C23C 2/20 | 118/63 |
| 2010/0282161 | A1* | 11/2010 | Fujioka | C23C 2/20 | 118/62 |

FOREIGN PATENT DOCUMENTS

| | | | |
|---|---|---|---|
| JP | 61-159365 | U | 10/1986 |
| JP | 2-131544 | U | 11/1990 |
| JP | 2007-284732 | A | 11/2007 |
| JP | 4641847 | B2 | 3/2011 |
| JP | 2012-219356 | A | 11/2012 |
| WO | WO 2007/142397 | A1 | 12/2007 |
| WO | WO 2012/153702 | A1 | 11/2012 |

* cited by examiner

WIPING NOZZLE OF HOT-DIP METAL PLATING EQUIPMENT AND WIPING POSITION CONTROL DEVICE FOR HOT-DIP METAL PLATING EQUIPMENT

TECHNICAL FIELD

The present invention relates to a wiping nozzle of hot-dip metal plating equipment and a wiping position control device for hot-dip metal plating equipment.

BACKGROUND ART

In hot-dip metal plating equipment, to adjust the thickness of hot-dip metal (zinc or the like) plating applied to a steel plate, wiping nozzles which face each other are disposed, one on a front surface side of the steel plate and the other on aback surface side thereof, and gas jets are blown onto the front surface and the back surface of the steel plate from these wiping nozzles.

Each of the above-described wiping nozzles has an internal space formed into a passage chamber for a compressed gas, and has a shape extended in a plate-width direction of a steel plate. In addition, a lip (a blowing port for the gas jet) in a front end of the wiping nozzle has the shape of a slit extending in the plate-width direction of the steel plate and is also designed to be longer than the plate width of the steel plate.

At opposite end portions of the steel plate in the plate-width direction, a disturbance occurs in the jet flow due to collision of the gas jets, which are blown out from the wiping nozzles facing each other as described above. This disturbance causes edge-overcoating, in which the plating becomes thicker on the edges than on and around a center portion of the steel plate in the plate-width direction, and splashing, in which the hot-dip metal scatters.

In view of this, there is a technique in which baffle plates are disposed at the opposite end portions of the steel plate in the plate-width direction, thereby reducing the edge-overcoating and the splashing. This technique is effective if the distance between each end portion of the plate and the corresponding baffle plate is set at 5 mm or less. However, since the steel plate as being passed meanders by approximately ±50 mm at a maximum, it is necessary to control the positions of the baffle plates such that the baffle plates follow the meandering but do not come into contact with the plate end portions with such a precision as to keep the distance from the plate end portions at approximately 5 mm or less. However, increasing the production speed also increases the speed of meandering, preventing the baffle plates from following the meandering. As a result, an accident in which the plate comes into contact with the baffle plate is likely to occur.

In view of this, Patent Documents 1 to 3 listed below disclose techniques to reduce edge-overcoating and splashing without using baffle plates.

PRIOR ART DOCUMENTS

Patent Documents

Patent Document 1: Japanese Patent Application Publication No. 2012-219356

Patent Document 2: Japanese Patent No. 4641847

Patent Document 3: Japanese Utility Model Registration Application Publication No. Sho 61-159365

SUMMARY OF THE INVENTION

Problems to be Solved by the Invention

Patent Document 1 discloses a technique in which masks are disposed on an outer side at opposite end portions of a lip in a plate-width direction (hereinafter, referred to as a lip plate-width direction, which is the same as the plate-width direction of a wiping nozzle). However, in this technique, disposing the masks on the outer side of the lip requires a longer distance between the wiping nozzle and a steel plate. This lowers the wiping ability with the gas jet. For this reason, it is necessary to increase the amount of gas consumed to be used for the gas jet. In addition, in thin plating processing, it is necessary to lower the speed of a plate in order to compensate the shortage of the wiping ability, which lowers the production of plated steel plates.

Patent Document 2 discloses a technique in which an internal space of a wiping nozzle is divided into two gas passage chambers, a belt is inserted in a connection passage provided between these gas passage chambers, and a thin plate is fixed to the belt. However, since this technique uses the belt capable of being wound up, it is necessary to lower the rigidity of the belt. This may cause deficiency in sliding and deficiency in positioning precision of the belt. In addition, the thin plate fixed to the belt seals in only the gas jet to be blown onto a region of the end portion of the steel plate, and the gas jet is blown out from a further outer side of the end portion. Thus, the amount of gas consumed cannot be reduced.

Patent Document 3 discloses a technique in which a wire is disposed inside a wiping nozzle, thereby controlling the blowing of a gas jet. However, in this technique, the gas flow is disturbed at end portions of the wire, and the wiping ability is lowered at the opposite end portions in the plate-width direction.

In view of this, an object of the present invention to provide a wiping nozzle of hot-dip metal plating equipment and a wiping position control device for hot-dip metal plating equipment, which are capable of reducing the amount of gas consumed, edge-overcoating, and splashing, as well as adjusting the plating thickness with high precision, while keeping the wiping ability.

Means for Solving the Problems

A wiping nozzle of hot-dip metal plating equipment according to a first invention for solving the above-described problems is a wiping nozzle of hot-dip metal plating equipment, including a lip which is a slit extending in a plate-width direction of a steel plate and blows a gas jet, and being configured to blow the gas jet onto the steel plate to adjust a plating thickness of the steel plate, characterized in that the wiping nozzle comprises:

thin plates inserted from an inlet of the lip into the lip at positions located inward respectively from end portions of the lip in the plate-width direction by a predetermined distance, to seal in the gas jet at inserted portions, the thin plates being capable of moving in the plate-width direction; and ropes extending in the plate-width direction in such a manner as to follow movements of the thin plates to seal in the gas jet in a range of the predetermined distance, thereby making variable a length of a blowing port for the gas jet of the lip in the plate-width direction.

A wiping nozzle of hot-dip metal plating equipment according to a second invention for solving the above-described problems is the wiping nozzle of hot-dip metal plating equipment according to the first invention, comprising:

two sliding tables capable of moving in the plate-width direction;

first pulleys disposed on the respective sliding tables;

second pulleys disposed on the respective sliding tables at positions inward of the corresponding first pulleys in the plate-width direction, and in contact with an inlet of the lip; and thin plate supporting portions disposed in such a manner as to have protrusions from the corresponding second pulleys inward in the plate-width direction, wherein each rope is wound on the corresponding first pulley and the corresponding second pulley, is fixed at opposite end portions thereof, and is slidably fitted to the inlet of the lip in a range from each of the opposite end portions to a contact point with the second pulley, and the thin plates are supported on the respective protrusions.

A wiping nozzle of hot-dip metal plating equipment according to a third invention for solving the above-described problems is the wiping nozzle of hot-dip metal plating equipment according to the first or second invention, wherein the thin plates are capable of moving in a direction opposite to the blowing direction.

A wiping position control device for hot-dip metal plating equipment according to a fourth invention for solving the above-described problems is a wiping position control device for hot-dip metal plating equipment, comprising:

wiping nozzles of hot-dip metal plating equipment according to the second or third invention, the wiping nozzles being disposed to face each other on a front surface side and a back surface side of the steel plate;

a plate end position measuring unit which measures positions of opposite end portions of the steel plate in the plate-width direction;

a sliding table drive position calculating unit which calculates positions of the sliding tables such that the positions correspond to the positions of the opposite end portions of the steel plate in the plate-width direction, based on a measurement result by the plate end position measuring unit; and a sliding table driving unit which drives the sliding tables, based on a calculation result by the sliding table drive position calculating unit.

Effects of the Invention

The wiping nozzle of hot-dip metal plating equipment and the wiping position control device for hot-dip metal plating equipment according to the present invention are capable of reducing the amount of gas consumed, edge-overcoating, and splashing, only with the functions inside the wiping nozzle. Thus any baffle plate is unnecessary, and a damping device and the nozzle can be arranged adjacent to each other to enhance the dampening effect. In addition, the reduction in splashing allows the distance between the wiping nozzle and the steel plate to be shortened, so that the wiping ability is improved and the plating thickness can be adjusted with high precision. Then, it is possible to achieve a uniform thin plating even at a high line speed, making it possible to enhance the production speed.

MODES FOR CARRYING OUT THE INVENTION

Hereinafter, a wiping nozzle of hot-dip metal plating equipment and a wiping position control device for hot-dip metal plating equipment according to embodiments of the present invention will be described with reference to the drawings.

Embodiment 1

Figure 1:
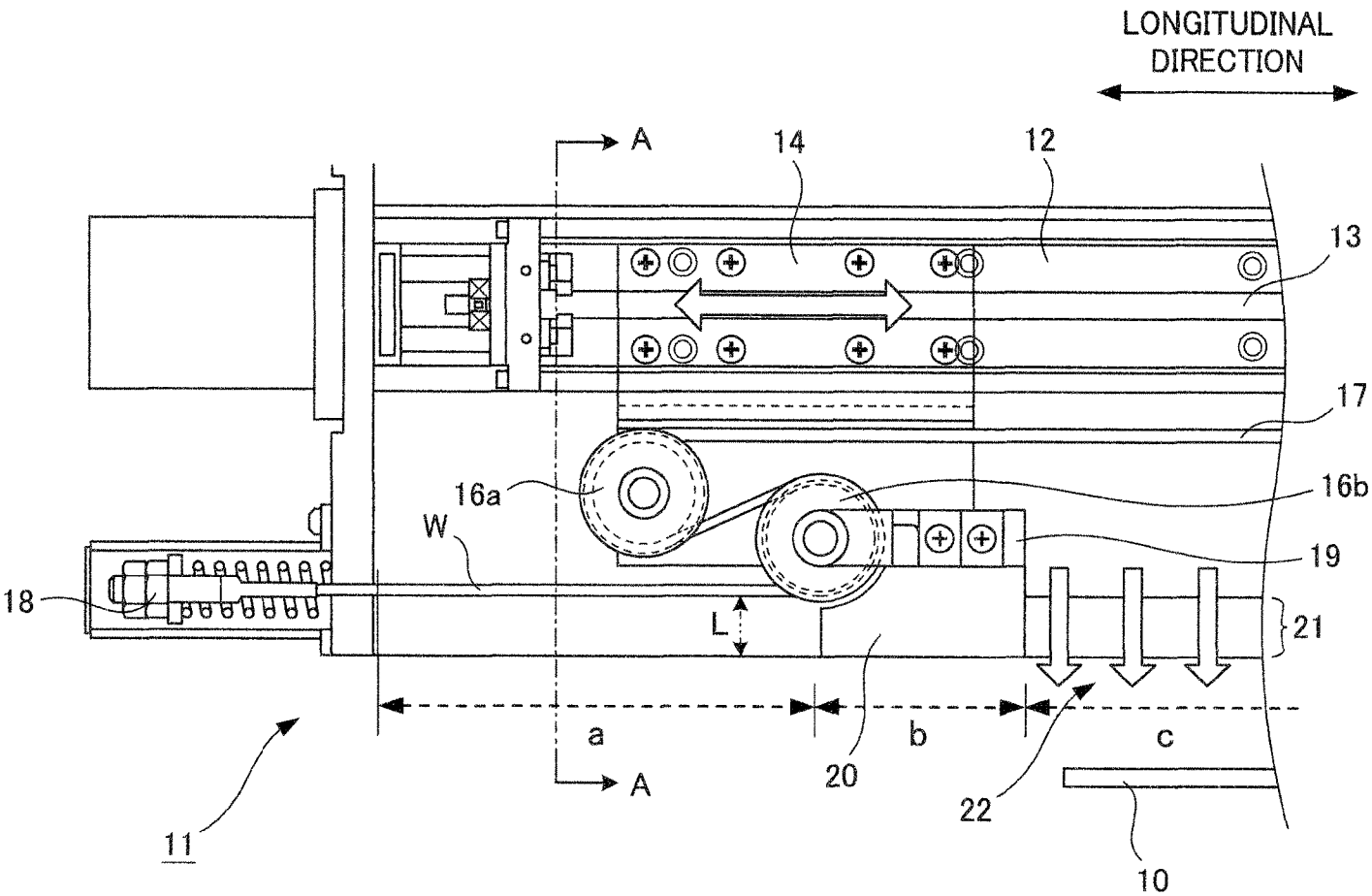
FIG. 1 is a top view for describing a wiping nozzle of hot-dip metal plating equipment according to Embodiment 1 of the present invention.
Figure 2:
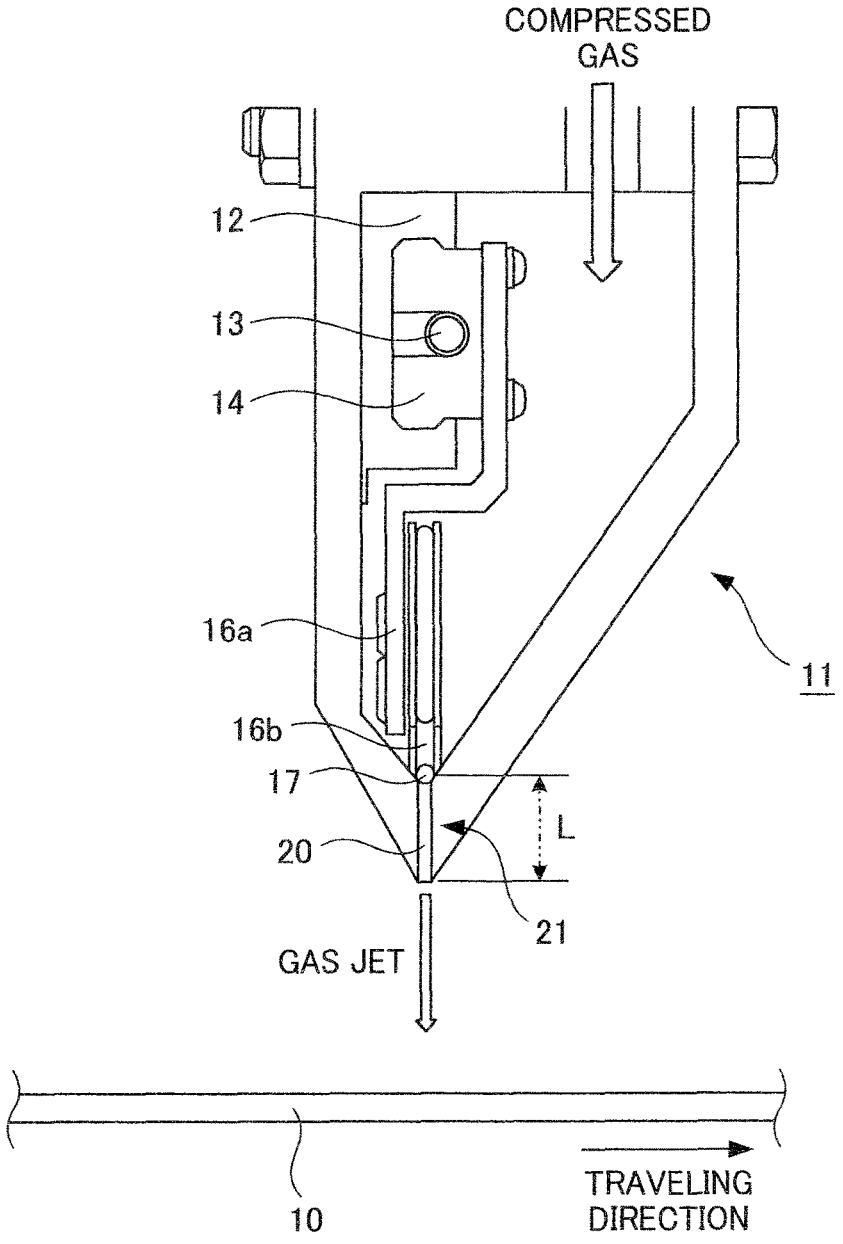
FIG. 2 is a view in a direction of arrows A-A in FIG. 1.

A wiping nozzle of hot-dip metal plating equipment according to Embodiment 1 of the present invention will be described with reference to FIGS. 1 and 2. FIG. 1 is a top view for explaining the wiping nozzle of hot-dip metal plating equipment according to Embodiment 1 of the present invention, and FIG. 2 is a view in a direction of arrows A-A in FIG. 1.

The wiping nozzle (wiping nozzle 11) of hot-dip metal plating equipment according to Embodiment 1 of the present invention has an internal space formed into a passage chamber for a compressed gas, and has a shape extended in a plate-width direction of a steel plate, like the conventional techniques. As illustrated in FIGS. 1 and 2, the wiping nozzle 11 includes a guide 12, a sliding table drive screw 13, a sliding table 14, a first pulley 16*a*, a second pulley 16*b*, a rope 17, a fixing portion 18, a thin plate supporting portion 19, a thin plate 20, and a lip 21, and is blowing a gas jet onto a steel plate 10 as indicated by outlined arrows in FIG. 1. Here, the guide 12, the sliding table drive screw 13, the sliding table 14, the first pulley 16*a*, the second pulley 16*b*, the rope 17, the fixing portion 18, the thin plate supporting portion 19, and the thin plate 20 are disposed inside the wiping nozzle 11.

Note that the mechanism illustrated in FIG. 1 is part of the wiping nozzle 11, and a mechanism obtained by laterally inverting the mechanism illustrated in FIG. 1 is provided on the opposite side in the lip plate-width direction (the same applied to FIGS. 3 and 5 described later). Hereinafter, only a range illustrated in FIG. 1 will be described.

The sliding table 14 is slidably fitted to the guide 12 extended in the lip plate-width direction. This allows the sliding table 14 to move in the lip plate-width direction as indicated by an outlined double-headed arrow in FIG. 1. In addition, the sliding table 14 is positioned by the sliding table drive screw 13.

The first pulley 16*a* and the second pulley 16*b* are each disposed on the sliding table 14. In addition, the second pulley 16*b* is disposed at a position inward of the first pulley 16*a* in the lip plate-width direction, and in contact with an inlet of the lip 21 (a portion with a length L).

The rope 17 extends in the lip plate-width direction and is wound on the first pulley 16*a* and the second pulley 16*b*. In addition, an end portion of the rope 17 is fixed to the fixing portion 18 disposed at an end portion in the lip plate-width direction, so that a tensile force is applied to the rope 17. Note that the material of the rope 17 may be a fiber, a metal, and the like, but is not particularly limited to any material here.

Moreover, the rope 17 is slidably fitted to the inlet of the lip 21 in a range W (see FIG. 1) from the end portion to a contact point with the second pulley 16*b*. This allows the rope 17 to seal in the gas jet blown out in a region a (see FIG. 1) from the end portion to the second pulley 16*b* in the lip 21. In other words, the rope 17 plays a role as a seal member.

The thin plate supporting portion 19 is disposed in such a manner as to have a protrusion from the second pulley 16*b* inward in the lip plate-width direction.

The thin plate 20 is supported on the protrusion of the thin plate supporting portion 19 and is inserted in the lip 21. This allows the thin plate 20 to seal in the gas jet blown out in a region b (see FIG. 1) further inward of the portion sealed by the rope 17 (inward of the second pulley 16*b* in the lip plate-width direction).

The lip 21 is configured such that since in the regions a and b in FIG. 1, the gas jet is sealed in by the rope 17 and the thin plate 20, a region c serves as a gas jet blowing port. Note that the region c is set to be longer than the plate width of the steel plate 10.

With the above-described configuration, when supplied with a compressed gas as indicated by the downward outlined arrows in FIG. 1, the wiping nozzle 11 blows out the gas jet from the lip 21. At this time, adjustment using the pulleys 16*a* and 16*b* causes the rope 17 and the thin plate 20 to move in the lip plate-width direction, thereby changing the ranges of the regions a and b where the gas jet is sealed in. As a result, the width of the region c in the gas jet blowing port can be changed.

In addition, although in FIG. 2, the thickness of the thin plate 20 is illustrated as being equal to a slit gap g of the lip 21, this embodiment is capable of securing the effect of blocking the gas jet even when the thickness of the thin plate 20 is set to be equal to or more than half of the gap g, but less than the gap g. Moreover, since there is almost no sliding resistance in moving the thin plate 20, the thin plate 20 can be moved smoothly even when the rope 17 is deflected or waved. Thus, the precision and response in positioning the thin plate 20 are improved.

Moreover, in FIGS. 1 and 2, the length of the thin plate 20 in a gas jet blow direction is illustrated as being equal to the length L of the slit of the lip 21 in the gas jet blow direction (hereinafter referred to as a "lip length L"). The length of the thin plate 20 in the gas jet blow direction is preferably equal to the lip length L as described here, but may be shorter than the lip length L.

Then, the width of the thin plate 20 in the lip plate-width direction (the region b in FIG. 1) is preferably equal to or more than the radius of the pulley 16*b*+20 mm from the center of the pulley 16*b*.

The wiping nozzle 11 has been described above, and what is important for the wiping nozzle 11 is that part of the gas jet from the lip 21 is sealed in by the rope 17 and the thin plate 20 placed inward thereof, and also, that the range to seal is made changeable.

As in the wiping nozzle described in Patent Document 3, with only the seal using a wire, the gas flow is disturbed at the end portions of the wire, and thus the wiping ability is lowered. By contrast, in the wiping nozzle 11, since the thin plate 20 is provided inward of the rope 17, the gas flow is not disturbed, and the wiping ability is improved.

In addition, in general, a wiping nozzle needs to be cleaned particularly at the tip of the lip. In this regard, when the length of the thin plate 20 in the gas jet blow direction is made equal (or substantially equal) to the lip length L, the thin plate 20 naturally serves as a cleaner as well, so that the tip of the lip 21 can be cleaned by the moving thin plate 20.

In other words, the wiping nozzle of hot-dip metal plating equipment according to Embodiment 1 of the present invention is a wiping nozzle of hot-dip metal plating equipment, including a lip which is a slit extending in a plate-width direction of a steel plate and blows a gas jet, and being configured to blow the gas jet onto the steel plate to adjust a plating thickness of the steel plate, the wiping nozzle including: a thin plate inserted from an inlet of the lip into the lip at a position located inward from each of end portions of the lip in the plate-width direction by a predetermined distance, to seal in the gas jet at an inserted portion, the thin plate being capable of moving in the plate-width direction; and a rope extending in the plate-width direction in such a manner as to follow movement of the thin plate to seal in the gas jet in a range of the predetermined distance.

Therefore, the wiping nozzle of hot-dip metal plating equipment according to Embodiment 1 of the present invention is capable of reducing the amount of gas consumed, edge-overcoating, and splashing only with the functions inside the wiping nozzle. Accordingly, any baffle plate is unnecessary, and a damping device and the nozzle can be arranged adjacent to each other to enhance the dampening effect. In addition, the reduction in splashing allows the distance between the wiping nozzle and the steel plate to be shortened, so that the wiping ability is improved and the plating thickness can be adjusted with high precision. Then, it is possible to achieve a uniform thin plating even at a high line speed, making it possible to enhance the production speed.

Embodiment 2

A wiping nozzle of hot-dip metal plating equipment according to Embodiment 2 of the present invention is configured by changing a configuration of part of the wiping nozzle of hot-dip metal plating equipment according to Embodiment 1, thereby stabilizing the gas flow at an inner end portion of the thin plate in the lip plate-width direction.

Hereinafter, the wiping nozzle of hot-dip metal plating equipment according to Embodiment 2 of the present invention will be described with reference to FIGS. 3 and 4. FIG. 3 is a top view for describing the wiping nozzle of hot-dip metal plating equipment according to Embodiment 2 of the present invention. FIG. 4 is a graph illustrating a distribution, in the plate-width direction of the wiping nozzle, of a ratio of a gas jet impact pressure to a maximum gas jet impact pressure of the wiping nozzle of hot-dip metal plating equipment according to Embodiment 2 of the present invention.

The wiping nozzle (wiping nozzle 31) of hot-dip metal plating equipment according to Embodiment 2 of the present invention has an internal space formed into a passage chamber for a compressed gas, and has a shape extended in a plate-width direction of a steel plate, like the wiping nozzle 11 of Embodiment 1. Then, as illustrated in FIG. 3, the wiping nozzle 31 includes a guide 12, a sliding table drive screw 13, a sliding table 14, a first pulley 16*a*, a second pulley 16*b*, a rope 17, a fixing portion 18, a thin plate supporting portion 19, a thin plate 40, and a lip 21.

The guide 12, the sliding table drive screw 13, the sliding table 14, the first pulley 16*a*, the second pulley 16*b*, the rope 17, the fixing portion 18, the thin plate supporting portion 19, and the lip 21 are the same as those of Embodiment 1, and thus will not be described.

The thin plate 40 is supported on a protrusion of the thin plate supporting portion 19 and is inserted in the lip 21, like the thin plate 20 of the Embodiment 1. This allows the thin plate 40 to seal in the gas jet blown out in a region b (see FIG. 1) further inward of the portion sealed by the rope 17 (inward of the second pulley 16*b* in the lip plate-width direction).

Moreover, in this embodiment, the inner end portion of the thin plate 40 in the lip plate-width direction is inclined, or the inner end portion in the lip plate-width direction is formed in an arc shape, to narrow an outlet side more than an inlet side in a gas jet blowing port (corresponding to the region c in FIG. 1) of the lip 21. Note that FIG. 2 illustrates the case where the inner end portion in the lip plate-width direction is inclined.

In the graph of FIG. 4, the vertical axis indicates (gas jet impact pressure)/(maximum gas jet impact pressure), and the horizontal axis indicates the coordinate (position) in the lip plate-width direction. In addition, it is assumed that the thin plate 40 is provided on the negative side of the point of 0 mm on the horizontal axis, and the inner end portion of the thin plate 40 in the lip plate-width direction is located at the point of 0 mm. Note that when (gas jet impact pressure)/(maximum gas jet impact pressure) is zero, it means that the gas jet is not blown at all from the wiping nozzle, and when (gas jet impact pressure)/(maximum gas jet impact pressure) is one, it means that the gas jet is being blown completely from the wiping nozzle (there is no influence of the sealing member on the gas flow).

As illustrated in the graph of FIG. 4, in the region provided with the thin plate 40, the gas jet is almost sealed in (from −20 mm to near 0 mm). On the other hand, in the region not provided with the thin plate 40, the gas jet is being blown completely (from near 0 mm to 20 mm). Then, near 0 mm, the blowing amount of the gas jet changes largely and stably.

Embodiment 3

As for the wiping nozzle of hot-dip metal plating equipment according to Embodiment 1 of the present invention, the configuration in which the thin plate serves as a cleaner as well, making it possible to clean the tip of the lip, has been described. A wiping nozzle of hot-dip metal plating equipment according to Embodiment 3 of the present invention is configured by changing configurations of part of the wiping nozzles of hot-dip metal plating equipment according to Embodiments 1 and 2 so as to cause the thin plate to move into the wiping nozzle, thereby improving convenience during cleaning by a worker and during cleaning using a separate cleaner.

Hereinafter, the wiping nozzle of hot-dip metal plating equipment according to Embodiment 3 of the present invention will be described with reference to Part (a) of FIG. 5. FIG. 5 is schematic views for describing the wiping nozzle of hot-dip metal plating equipment according to Embodiment 3 of the present invention, and Part (a) of FIG. 5 illustrates the event of sealing a nozzle lip.

The wiping nozzle (wiping nozzle 51) of hot-dip metal plating equipment according to Embodiment 3 of the present invention has an internal space formed into a passage chamber for a compressed gas, and has a shape extended in a plate-width direction of a steel plate, like the wiping nozzles 11 and 31 of Embodiments 1 and 2. Then, as illustrated in Parts (a) and (b) of FIG. 5, the wiping nozzle 51 includes a guide (not illustrated), a sliding table drive screw (not illustrated), a spring 52, a sliding table 54, a first pulley 56*a*, a second pulley 56*b*, a rope 17, a fixing portion (not illustrated), a lever 59, a thin plate 60, and a lip 21.

The guide, the sliding table drive screw, the rope 17, the fixing portion, and the lip 21 are the same as those of Embodiments 1 and 2, and thus will not be described.

The sliding table 54, although not illustrated, is slidably fitted to the guide extended in a lip plate-width direction, like the sliding tables 14 in Embodiments 1 and 2. This allows the sliding table 54 to move in the lip plate-width direction. In addition, the sliding table 54 is positioned by the sliding table drive screw 13. Moreover, in this embodiment, the spring 52 is disposed on the sliding table 54.

The lever 59 is connected to the spring 52, and disposed on a rotational shaft 53*a* of the first pulley 56*a* and a rotational shaft 53*b* of the second pulley 56*b*. The lever 59 is disposed in such a manner as to have a protrusion from the second pulley 56*b* inward in the lip plate-width direction.

In addition, the rotational shaft 53*a* of the first pulley 56*a* is fixed to the sliding table 54, and the rotational shaft 53*b* of the second pulley 56*b* is not fixed.

The thin plate 60 is supported on the protrusion of the lever 59, and is inserted in the lip 21. This allows the thin plate 60 to seal in the gas jet blown out in a region (see the region b in FIG. 1) further inward of the portion sealed by the rope 17 (inward of the second pulley 56*b* in the lip plate-width direction). In other words, in this embodiment, the lever 59 plays also a role of the thin plate supporting portion 19 in Embodiments 1 and 2.

Figure 5B:
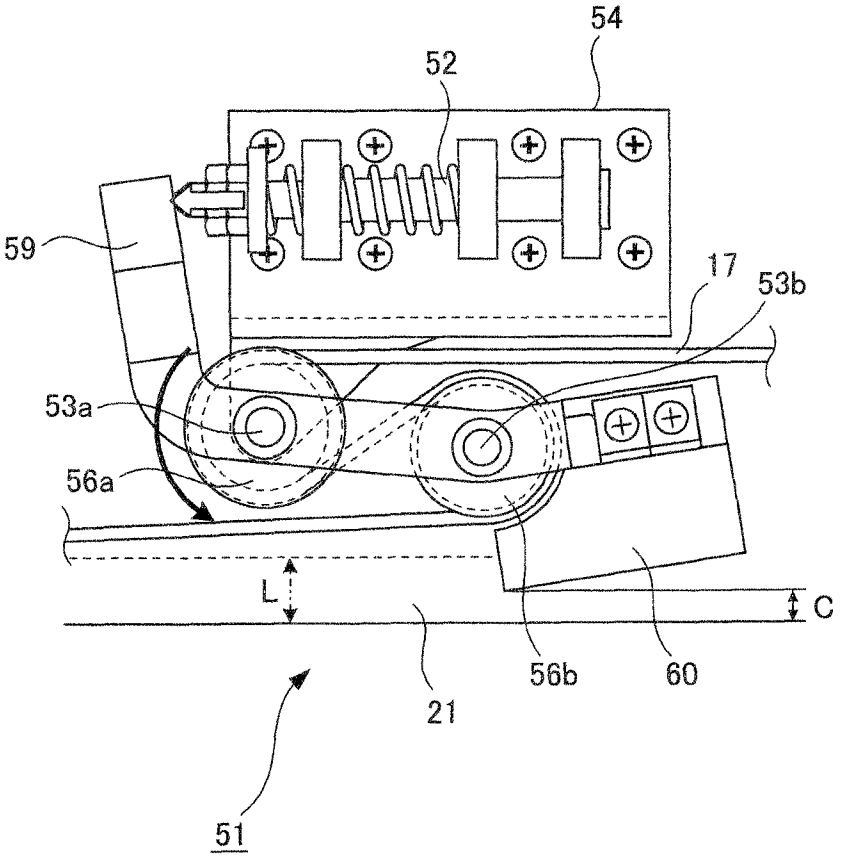
FIG. 5 is schematic views for describing a wiping nozzle of hot-dip metal plating equipment according to Embodiment 3 of the present invention, Part (a) illustrates the event of sealing a nozzle lip, and Part (b) illustrates the event of cleaning.
Figure 5A:
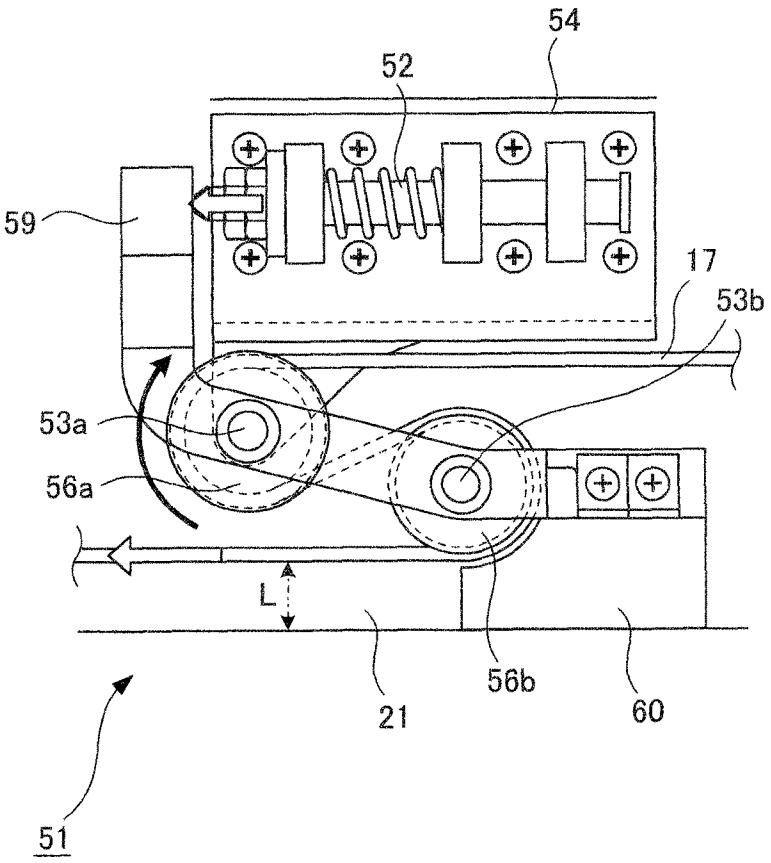

In addition, in this embodiment, as illustrated in Part (a) of FIG. 5, the length of the thin plate 60 in the gas jet blow direction is equal to the lip length L.

Figure 3:
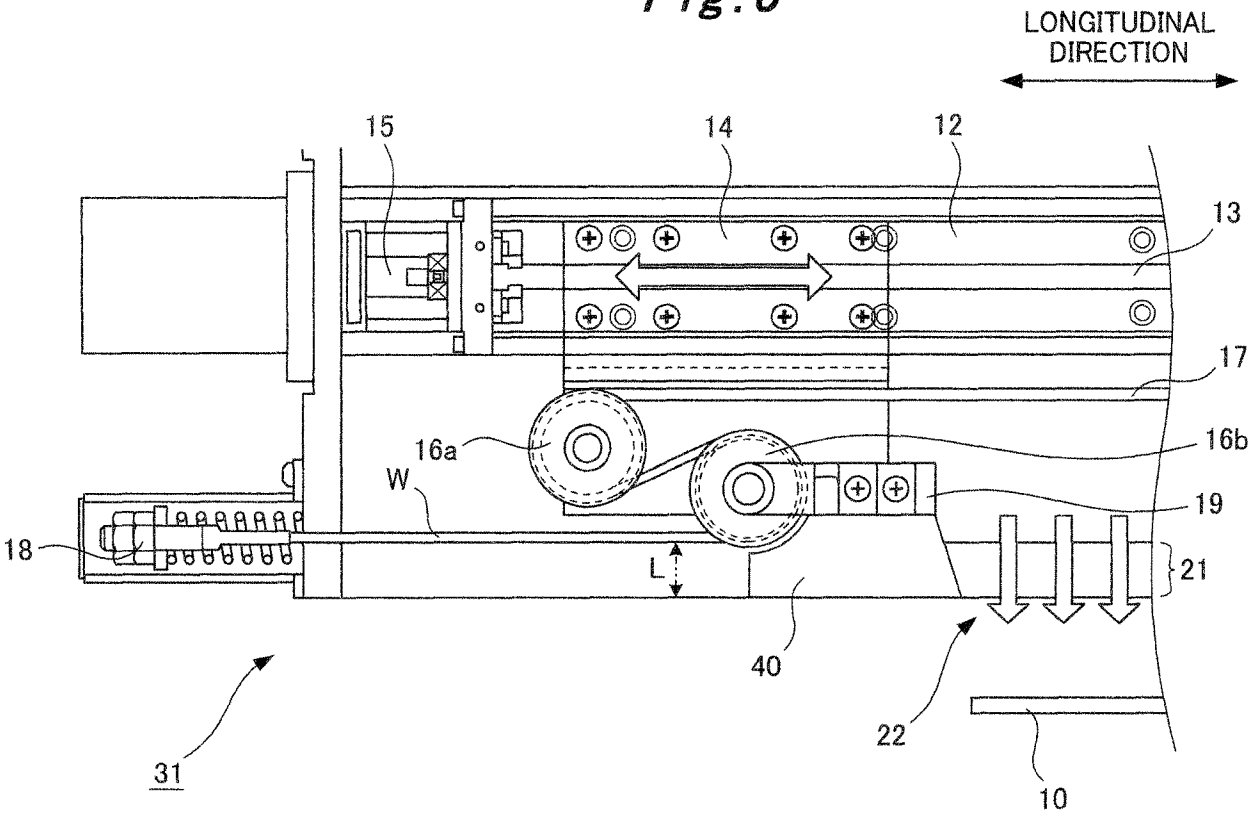
FIG. 3 is a top view for describing a wiping nozzle of hot-dip metal plating equipment according to Embodiment 2 of the present invention.
Figure 4:
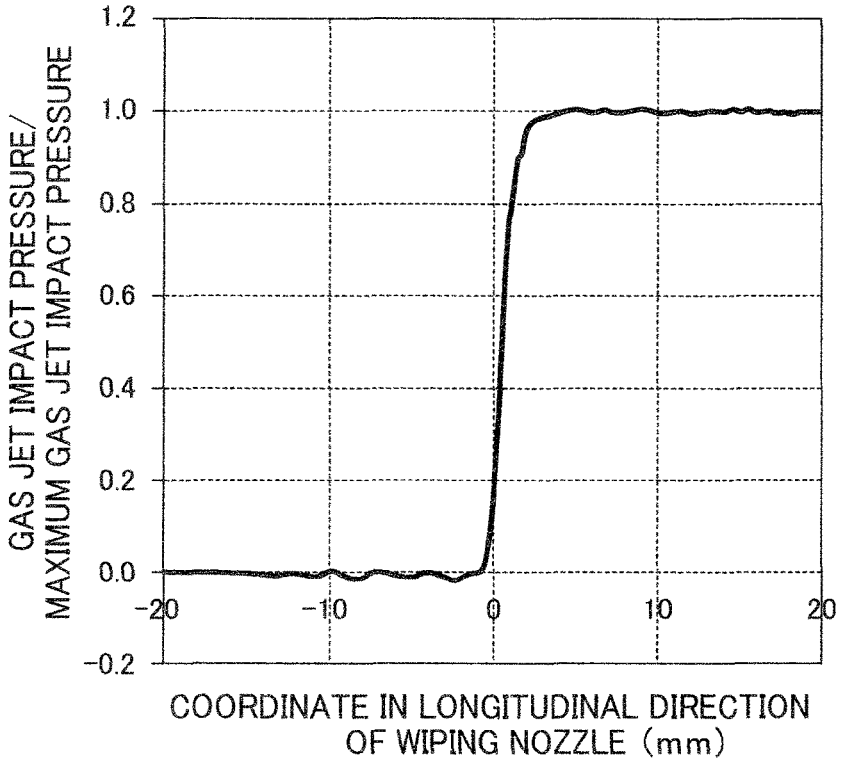
FIG. 4 is a graph illustrating a distribution, in a plate-width direction of the wiping nozzle, of a ratio of a gas jet impact pressure to a maximum gas jet impact pressure of the wiping nozzle of hot-dip metal plating equipment according to Embodiment 2 of the present invention.

In the wiping nozzle 51 of the above-described configuration, in the event of sealing the nozzle lip, as indicated by an outlined arrow on the rope 17 in Part (a) of FIG. 5, a tensile force is applied to the rope 17 by the fixing portion (see the fixing portion 18 in FIGS. 1 and 3). In addition, as indicated by an outlined arrow on the spring 52, a spring force is applied to the lever 59 by a spring 52. Then, the tensile force and the spring force are balanced out so that the thin plate 60 is stopped at a predetermined position.

How the lip 21 of the wiping nozzle 51 is cleaned will be described below with reference to Part (b) of FIG. 5. Note that Part (b) of FIG. 5 illustrates one for the event of cleaning among the schematic views for describing the wiping nozzle of the hot-dip metal plating equipment according to Embodiment 3 of the present invention.

First, the tensile force applied to the rope 17 by the fixing portion is removed. Once the tensile force is removed, the lever 59 is rotated about the rotational shaft 53*a* of the first pulley 56*a* by the spring force of the spring 52. The rotation of the lever 59 about the rotational shaft 53*a* causes the second pulley 56*b* and the protrusion of the lever 59 to move away from the lip 21. Thus, the thin plate 60 also moves away from the tip of the lip 21 (C in Part (b) of FIG. 5).

In other words, the wiping nozzle of hot-dip metal plating equipment according to Embodiment 3 of the present invention is such that in a case where the thin plate and the lip have an equal length in the blowing direction of the gas jet, when the thin plate is made movable in a direction opposite to the blowing direction, it is possible to maximize the advantageous effect by sealing the entire lip length L, and also to prevent the thin plate from obstructing the cleaning of the tip of the lip. Thus the convenience in cleaning is improved, leading to avoidance of clogging of the lip and improvement in operation rate.

Note that in this embodiment, the cleaning of the tip of the lip may be conducted by a worker, or may be automatically conducted by providing a cleaner.

Embodiment 4

A wiping position control device for hot-dip metal plating equipment according to Embodiment 4 of the present invention is a device that performs such control that the positions of the thin plates of the wiping nozzle of hot-dip metal plating equipment according to any of Embodiments 1 to 3 follow the positions of the opposite end portions of a steel plate in the plate-width direction, during plate-width change or meandering of the steel plate.

Figure 6A:
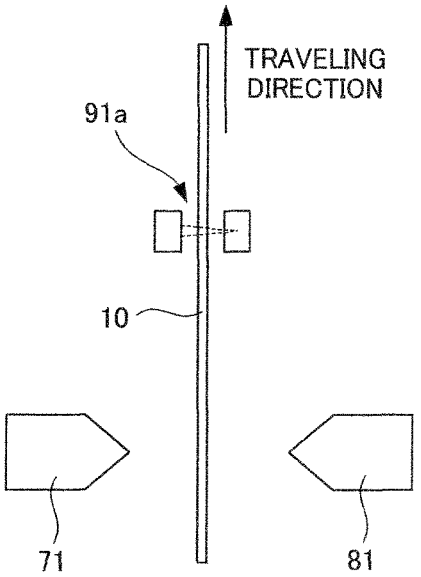
FIG. 6 is schematic views for describing a wiping position control device for hot-dip metal plating equipment according to Embodiment 4 of the present invention, Part (a) illustrates a side view, Part (b) illustrates a top view, and Part (c) illustrates a flowchart.
Figure 6C:
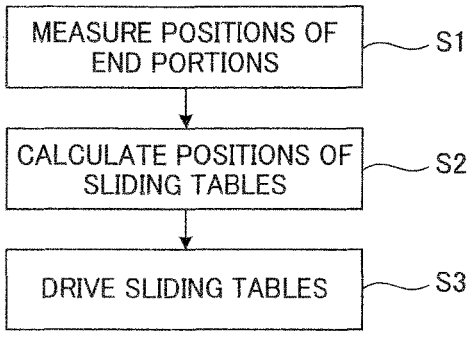
Figure 6B:
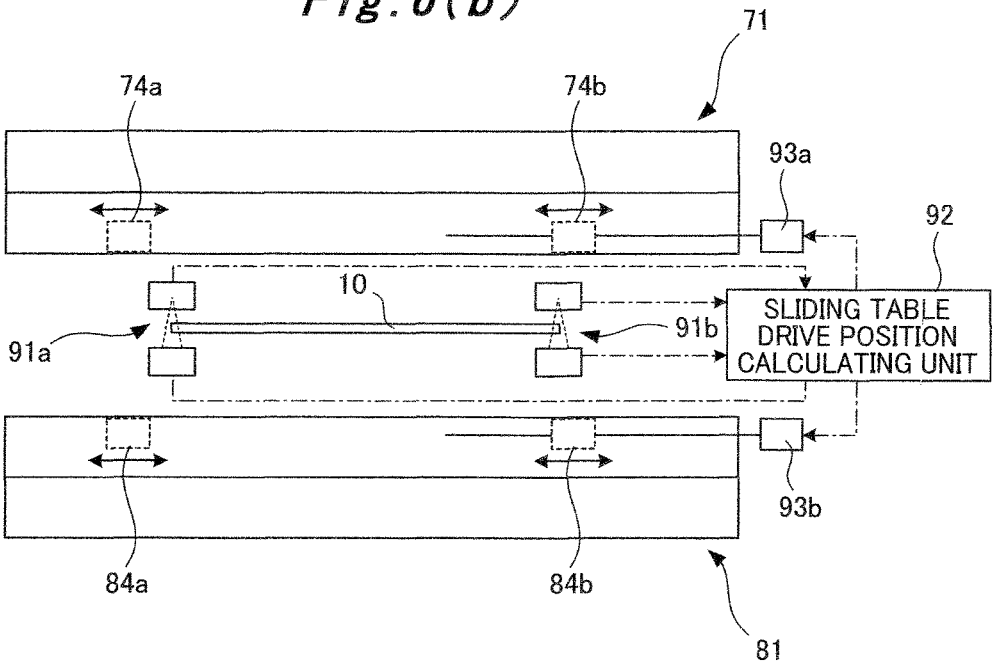

First, the wiping position control device for hot-dip metal plating equipment according to Embodiment 4 of the present invention will be described with reference to FIG. 6. FIG. 6 is schematic views for describing the wiping position control device for hot-dip metal plating equipment according to Embodiment 4 of the present invention. Part (a) of FIG. 6 illustrates a side view, Part (b) of FIG. 6 illustrates a top view, and Part (c) of FIG. 6 illustrates a flowchart.

As illustrated in Parts (a) and (b) of FIG. 6, the wiping position control device for hot-dip metal plating equipment according to Embodiment 4 of the present invention includes a first wiping nozzle 71, a second wiping nozzle 81, plate end position measuring units 91*a*, 91*b*, a sliding table drive position calculating unit 92, and sliding table driving units 93*a*, 93*b*.

The wiping nozzles 71, 81 have the same configuration as those of the wiping nozzles 11, 31, 51 of Embodiments 1 to 3, and disposed to face each other on a front surface side and a back surface side of a steel plate 10. Note that Part (b) of FIG. 6 illustrates only sliding tables 74*a*, 74*b* inside the wiping nozzle 71 and sliding tables 84*a*, 84*b* inside the wiping nozzle 81.

The plate end position measuring units 91*a*, 91*b* are sensors for measuring the positions of the opposite end portions of the steel plate 10 in a plate-width direction.

The sliding table drive position calculating unit 92 calculates the positions of the sliding tables 74*a*, 74*b*, 84*a*, 84*b* such that the positions correspond to the positions of the opposite end portions of the steel plate 10 in the plate-width direction, based on a measurement result by the plate end position measuring units 91*a*, 91*b*.

The sliding table driving units 93*a*, 93*b* drive the sliding tables 74*a*, 74*b*, 84*a*, 84*b*, based on a calculation result by the sliding table drive position calculating unit 92.

With the above-described configuration, as illustrated in the flowchart of Part (c) of FIG. 6, the wiping position control device for hot-dip metal plating equipment according to Embodiment 4 of the present invention: first measures the positions of the opposite end portions of the steel plate 10 in the plate-width direction with the plate end position measuring units 91*a*, 91*b* as step S1; next calculates the positions of the sliding tables 74*a*, 74*b*, 84*a*, 84*b* such that the positions correspond to the positions of the opposite end portions of the steel plate 10 in the plate-width direction with the sliding table drive position calculating unit 92 as step S2; and drives the sliding tables 74*a*, 74*b*, 84*a*, 84*b* with the sliding table driving units 93*a*, 93*b* as step S3. In this way, the device performs such control that the positions of the thin plates (see the thin plate 20 in FIG. 1) follows the positions of the opposite end portions of the steel plate 10 in the plate-width direction, during plate-width change or meandering of the steel plate 10.

The wiping position control device for hot-dip metal plating equipment according to Embodiment 4 of the present invention have been described above. In other words, the wiping position control device for hot-dip metal plating equipment according to Embodiment 4 of the present invention is a wiping position control device for hot-dip metal plating equipment, including: wiping nozzles of hot-dip metal plating equipment, each of which is any one of the wiping nozzles according to Embodiments 1 to 3 and which are disposed to face each other on a front surface side and a back surface side of the steel plate; a plate end position measuring unit which measures positions of opposite end portions of the steel plate in a plate-width direction; a sliding table drive position calculating unit which calculates positions of the sliding tables such that the positions correspond to the positions of the opposite end portions of the steel plate in the plate-width direction, based on a measurement result by the plate end position measuring unit; and a sliding table driving unit which drives the sliding tables, based on a calculation result of the sliding table drive position calculating unit.

Therefore, the wiping position control device for hot-dip metal plating equipment according to Embodiment 4 of the present invention is capable of causing a gas jet blowing region of the wiping nozzle to follow an appropriate position in conformity with the steel plate, during plate-width change or meandering of the steel plate, and thus enables the wiping of the opposite end portions in the plate-width direction accurately.

INDUSTRIAL APPLICABILITY

The present invention is favorably applicable to a wiping nozzle of hot-dip metal plating equipment and a wiping position control device for hot-dip metal plating equipment.

REFERENCE SIGNS LIST

11, 31, 51, 71, 81 WIPING NOZZLE
12 GUIDE
13 SLIDING TABLE DRIVE SCREW
14, 54, 74*a*, 74*b*, 84*a*, 84*b* SLIDING TABLE
16*a* FIRST PULLEY
16*b* SECOND PULLEY
17 ROPE (SEAL MEMBER)
18 FIXING PORTION
19 THIN PLATE SUPPORTING PORTION
20, 40, 60 THIN PLATE
52 SPRING
53*a* FIRST PULLEY ROTATIONAL SHAFT
53*b* SECOND PULLEY ROTATIONAL SHAFT
56*a* FIRST PULLEY
56*b* SECOND PULLEY
59 LEVER

91*a*, 91*b* PLATE END POSITION MEASURING UNIT
92 SLIDING TABLE DRIVE POSITION CALCULATING UNIT
93*a*, 93*b* SLIDING TABLE DRIVING UNIT

The invention claimed is:

1. A wiping nozzle of hot-dip metal plating equipment, including a lip which is a slit extending in a plate-width direction of a steel plate and blows a gas jet, and being configured to blow the gas jet onto the steel plate to adjust a plating thickness of the steel plate, characterized in that the wiping nozzle comprises:

plates inserted from an inlet of the lip into the lip at positions located inward respectively from end portions of the lip in the plate-width direction by a predetermined distance, to seal in the gas jet at inserted portions, the plates being capable of moving in the plate-width direction; and ropes extending in the plate-width direction in such a manner as to follow movements of the plates to seal in the gas jet in a range of the predetermined distance, thereby making variable a length of a blowing port for the gas jet of the lip in the plate-width direction;

the wiping nozzle comprising:

two sliding tables capable of moving in the plate-width direction;

first pulleys disposed on the respective sliding tables;

second pulleys disposed on the respective sliding tables at positions inward of the corresponding first pulleys in the plate-width direction, and in contact with an inlet of the lip; and protrusions disposed from the corresponding second pulleys inward in the plate-width direction, wherein each rope is wound on the corresponding first pulley and the corresponding second pulley, is fixed at opposite end portions thereof, and is slidably fitted to the inlet of the lip in a range from each of the opposite end portions to a contact point with the corresponding second pulley, and the plates are supported on the respective protrusions.

2. The wiping nozzle of hot-dip metal plating equipment according to claim 1, wherein the plates are capable of moving in a direction opposite to a blowing direction of the gas jet.

3. A wiping position control device for hot-dip metal plating equipment, comprising:

a plurality of wiping nozzles of hot-dip metal plating equipment according to claim 1, the wiping nozzles being disposed to face each other on a front surface side and a back surface side of the steel plate;

a plate end position measuring unit which measures positions of opposite end portions of the steel plate in the plate-width direction;

a sliding table drive position calculating unit which calculates positions of the sliding tables such that the positions correspond to the positions of the opposite end portions of the steel plate in the plate-width direction, based on a measurement result by the plate end position measuring unit; and a sliding table driving unit which drives the sliding tables, based on a calculation result by the sliding table drive position calculating unit.

4. A wiping position control device for hot-dip metal plating equipment, comprising:

a plurality of wiping nozzles of hot-dip metal plating equipment according to claim 2, the wiping nozzles being disposed to face each other on a front surface side and a back surface side of the steel plate;

a plate end position measuring unit which measures positions of opposite end portions of the steel plate in the plate-width direction;

a sliding table drive position calculating unit which calculates positions of the sliding tables such that the positions correspond to the positions of the opposite end portions of the steel plate in the plate-width direction, based on a measurement result by the plate end position measuring unit; and a sliding table driving unit which drives the sliding tables, based on a calculation result by the sliding table drive position calculating unit.

* * * * *